United States Patent [19]

Lohr

[11] 4,188,750

[45] Feb. 19, 1980

[54] CONTROL CABLE

[76] Inventor: Raymond J. Lohr, 5043 Sterrettania, Erie, Pa. 16506

[21] Appl. No.: 846,718

[22] Filed: Oct. 31, 1977

[51] Int. Cl.[2] ..... A63H 29/22; A63H 33/26

[52] U.S. Cl. ..... 46/253

[58] Field of Search ..... 46/210, 253; 104/149; 272/31 R, 31 A; 273/86 B

[56] References Cited

U.S. PATENT DOCUMENTS

| | | | |
|---|---|---|---|
| 2,723,492 | 11/1955 | Muller | 46/253 |
| 3,022,070 | 2/1962 | Schlau | 272/31 R |
| 3,581,668 | 6/1971 | Ingels | 46/253 |
| 4,007,646 | 2/1977 | De Jonge | 46/210 UX |

*Primary Examiner*—Louis G. Mancene
*Assistant Examiner*—Robert P. Swiatek
*Attorney, Agent, or Firm*—Charles L. Lovercheck

[57] ABSTRACT

A control cable for controlling a device both mechanically and electrically. The device is made up of a spring wire dipped in an insulation material such as vinyl and an electrical conductor which is wrapped around the spring wire and coating and redipped in the insulation material.

9 Claims, 7 Drawing Figures

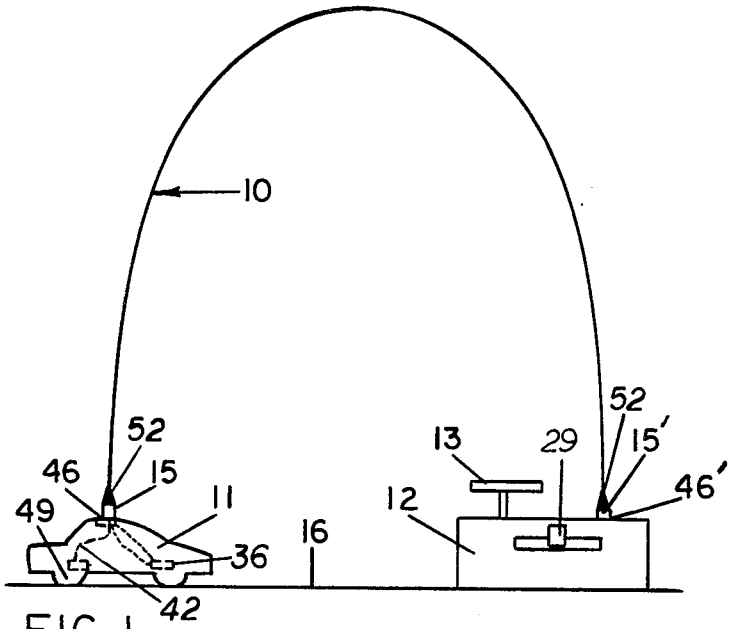
FIG. 1.
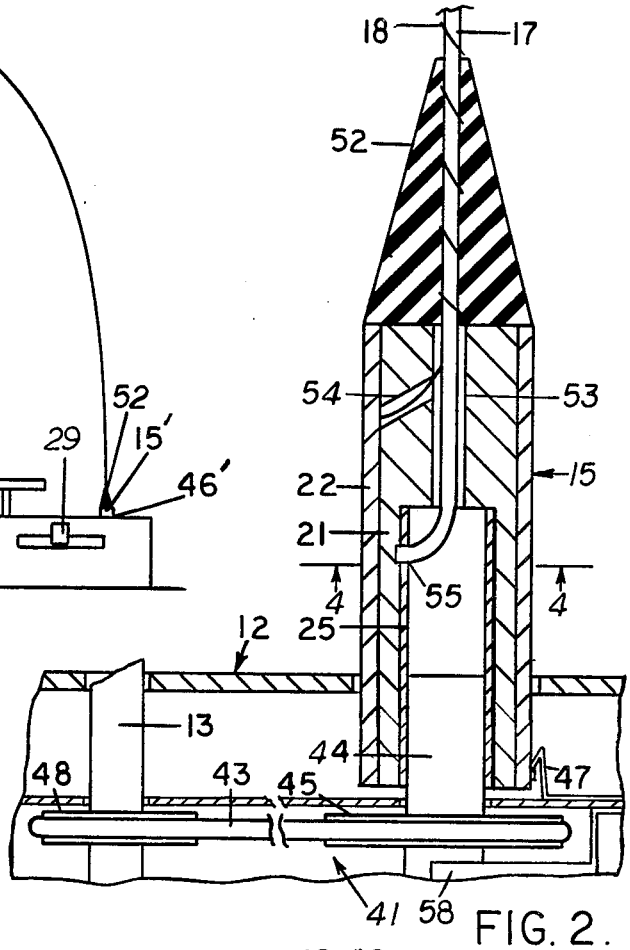
FIG. 2.
FIG. 3.
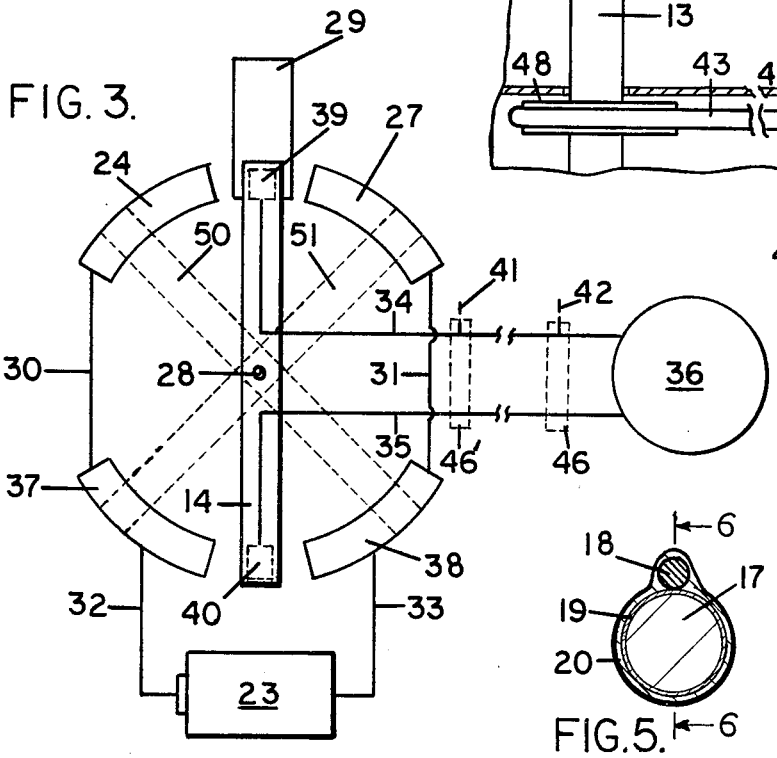
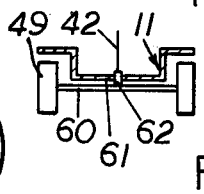
FIG. 7.
FIG. 4.
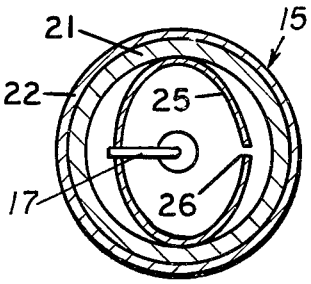
FIG. 5.
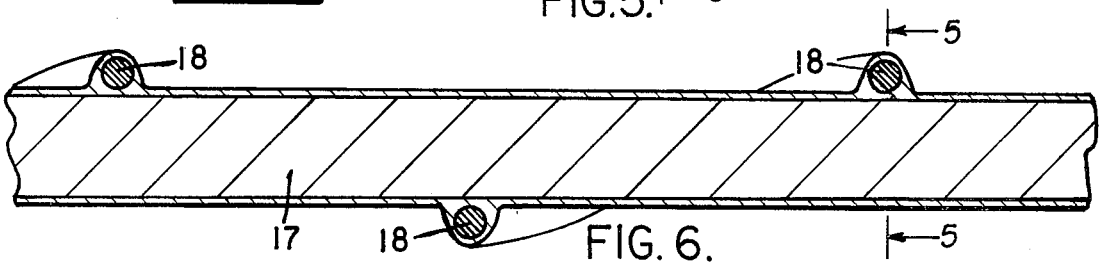
FIG. 6.

CONTROL CABLE

GENERAL STATEMENT OF THE INVENTION

The invention involves a control cable which can be used as a remote control for a toy such as a car. The control cable can control both start and stop and forward and rearward motion of the toy through an electrical circuit. At the same time, the toy can be steered mechanically through the control cable.

OBJECTS OF THE INVENTION

It is an object of the invention to provide a control cable of minimum size for connecting a control member to a device to control it both electrically and mechanically.

Another object of the invention is to provide a control cable which will provide an electric circuit and mechanical torque for control purposes.

Another object of the invention is to provide a unitary control cable which will arch above an operating surface.

Another object of the invention is to provide a control cable which is light in weight.

Another object of the invention is to provide a control cable that is simple to use, economical to manufacture and efficient in operation.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 1 is a diagrammatic view of the control cable and control box shown with a toy car.

FIG. 2 is a cross-sectional side view of the control cable connector, receptacle and steering mechanism.

FIG. 3 is a schematic view of the electrical circuit.

FIG. 4 is a cross-sectional end view of the control cable connector taken at line 4—4 of FIG. 2.

FIG. 5 is a cross-sectional end view of the control cable taken at line 5—5 of FIG. 6.

FIG. 6 is a partial, cross-sectional side view of the control cable according to the invention taken on line 6—6 of FIG. 5.

FIG. 7 is a partial, cross-sectional view of the toy vehicle.

DETAILED DESCRIPTION OF THE DRAWINGS

Now, with more particular reference to the drawings, the present invention is a control cable shown generally at 10, which is readily adaptable to be used to operate a toy car 11, or the like, from a remote control box 12 which contains the steering wheel 13 and the battery 23 or other source of electrical power. The control box also contains the switch 14 which controls both the forward and reverse directions of movement of the toy, as well as regulating its speed. The toy car 11 can be steered by the steering wheel 13 over the flat surface 16. The control cable 10 may take the form of an arch above the flat surface 16. The arching of the control cable keeps it off the flat surface 16 and does not hamper the movement of the car 11.

The control cable 10 is made up of a suitable length of wire 17. A three to four foot length has been found suitable for the purpose. At each end of the control cable, the cable 10 has a connector 15 and another connector 15'. These connectors are interchangeable and will plug into the control box 12 and the toy car 11. The control cable is made up of a spring wire 17, which may be of a suitable diameter, for example, twenty to thirty thousandths of an inch in diameter, depending on the strength required. The spring wire is used to carry electric current, as well as to provide a mechanical control means. The spring wire 17 is turned or twisted by the steering wheel 13 by a belt 43 running over pulleys 45 and 48. A second electrical conductor is provided by a small wire 18 which may be approximately eight thousandths of an inch in diameter and which may be wound around the spring wire with an insulation between the wire 17 and wire 18.

To make the control cable 10 according to the invention, a spring wire 17 is dipped in a vinyl or other suitable insulation material in the liquid state. This vinyl material is permitted to harden and the resulting vinyl coating 19 provides electrical insulation for the spring wire 17. The first vinyl coating 19 then has the small wire 18 wound around it and electrically insulated from it. The control cable 10 is then, once again, dipped in a vinyl material, thus applying a second vinyl coating 20, which provides electrical insulation around the control cable, as shown in FIG. 5.

The interchangeable connectors 15 and 15' consist of sleeves 25 which are attached to each end of the spring wire 17. A plastic insulator 21 is placed around each sleeve 25, electrically separating the sleeve from the bushing 22 which is placed around the plastic insulator and electrically connected to the small wire 18. When the connector 15 or 15' is inserted into a receptacle 46 or 46', the bushing 22 will engage a brush 47, and the sleeve 25 will engage a brush 58. The brushes 47 and 58 in receptacle 46 are connected to the motor 36. The brushes 47 and 58 in receptacle 46' are connected through the switch to the electrical source 23.

The sleeve 25 is generally cylindrical in shape and is discontinuous at a crack 26 which extends the length of the sleeve 25. The sleeve 25 is rigidly connected to the spring wire 17 at hole 55. When the connector, 15 or 15', is inserted in the receptacle 46 or 46', the center post 44 is forced into the center of the sleeve 25, which is slightly smaller than the post 44. The sleeve 25 grips the post 44, providing a mechanical control link. The crack 26 permits the sleeve 25 to expand to hold post 44. Contact 47 in receptacle 46 or 46' electrically connects through the bushing 22 with the small wire 18. A rubber nipple 52 is attached to the rear of the connector 15 or 15' with the control cable 10 running through it. The nipple prevents kinking of the control cable where it exits the connector. The insulator 21 has a hole 53 through which the control cable enters the connector. The insulator 21 also has a hole 54 through which the small wire 18 runs to connect to the bushing 22.

Wire 42 connects spring wire 17 to the king bolt 62, which is fixed to the axle 60 having front wheels 49 thereon. The axle freely swings with the king bolt 62, which rotates in the floor 61 of the toy vehicle, and as the wire 17 is rotated, the front axle 60 is steered.

The control box has a battery 23 to supply electric current. The battery is connected to a first wire 32, which is connected to a first plate 37, which is connected to a first potentiometer 24 through a second wire 30. The other pole of the battery is connected to a second plate 38 by wire 33 and to a second potentiometer 27 by wire 31. The switch 14 has a handle 29 which extends from the side of the box where it can be hand operated, turning on pivot 28. The switch has a plate contact 40 and a potentiometer contact 39. The plate contact 40 is connected to the receptacle 46' by wire 35 and the potentiometer contact 39 is connected to the receptacle 46' by wire 34.

An operator can move the switch 14 by engaging the handle 29. When the switch is moved to a position indicated at 51, potentiometer 27 and plate 37 are engaged and the motor 36 in the toy will be operated in a forward direction. The speed of the toy will increase as the switch 14 is moved closer to the end of potentiometer 27 adjacent the wire 31. When the switch is moved to a position indicated at 50, potentiometer 24 and plate 38 are engaged and the motor 36 will be operated in a rearward direction.

The post 44 in receptacle 46' has a pulley 45 rigidly affixed to it. Belt 43 runs over the pulley 45 and over the pulley 48 affixed to the steering wheel 13.

When the operator turns the steering wheel 13, the pulley 48 moves the belt which turns the pulley 45 which turns the post 44 which is mechanically connected at 41 to the spring wire 17 by sleeve 25. When the post 44 turns the sleeve 25, the spring wire 17 is rotated, which will turn the sleeve in the second connector 15' which is mechanically connected at 42 to the directional wheels 49 of the toy. Thus, the steering wheel 13 on the control box steers the toy. A suitable friction connection is provided by the belt and pulley to prevent damage to the spring wire when the steering wheel 13 is over-steered.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A control cable for connecting a control member to a device both mechanically and electrically comprising, a resilient, single, flexible spring wire having a first end and a second end, a relatively flexible conductor having a first end and a second end, said conductor being generally co-extensive with said wire, first control means on said first end of said wire connecting said wire to a mechanical control member, first connector means on said first end of said wire providing an electrical path to a source of electricity, second control means on said second end of said wire connecting said wire to said mechanical control member on said device, second connector means on said second end of said wire providing an electrical path to a drive member on said device, said control cable being supported by the said wire in arched relation above a level surface whereby the control cable provides a mechanical connection from said mechanical control member to said device and an electrical connection from said source of electricity to said device for driving and steering.

2. The control cable recited in claim 1 wherein the wire has a diameter of about 20 to 30 thousandths of an inch and the conductor has a diameter of from 6 to 10 thousandths of an inch.

3. The control cable recited in claim 2 wherein said connectors have a resilient generally cone shaped member adjacent an end to prevent kinking of the control cable at the connector.

4. The control cable recited in claim 1 wherein said first control means and said first connector means form a connection member comprising, a bushing, generally cylindrical in shape, electrically connected to said conductor, said bushing provides an electrical contact, an insulator disposed inside the bushing and generally concentric thereto, a sleeve, generally cylindrical in shaped is disposed inside the insulator and generally concentric thereto, said sleeve is electrically connected to said spring wire and has a longitudinal split which permits the sleeve to expand when it is inserted into a receptacle and forced onto a plug, said sleeve grips a center plug, providing a mechanical tortional control means.

5. The control cable recited in claim 1 wherein receptacles for said connectors are provided on said device and said receptacles are located in the top surface of the control box and the device to assist the arch of the spring wire, thus, keeping the control cable off the surface and out of the way of the device.

6. The control cable recited in claim 5 wherein said device is a toy.

7. In combination, a control, a control cable and a toy vehicle, said control cable comprising a spring wire having a conductor wire wound around it, insulation material securing said conductor wire to said spring wire, a steering wheel, means connecting said steering wheel to said spring wire, a source of electricity, brush means connecting said source of electricity to said spring wire and to said conductor wire, steering means and motor means on said vehicle, means connecting said spring wire to said steering means to rotate said steering means in response to the rotation of said steering wheel and means connecting said source of electricity to said motor through said conductor wire and through said spring wire whereby said motor is driven from said battery and said steering is controlled by said steering wheel.

8. The control cable recited in claim 7 wherein a control box is provided, the control box has a switch comprising, a first potentiometer and a second potentiometer, a first contact connected to the first potentiometer and a second contact connected to the second potentiometer, said potentiometers and said contacts being disposed in the form of a circle, said contacts are connected to a source of electricity, a bar, pivoted at the center of said circle between the potentiometer and the contacts, said bar having a first pad on one end electrically connected to a first side of a receptacle and a second pad spaced from the first pad, electrically connected to a second side of a receptacle whereby when the bar is in a center position it is between said contacts and no electrical current will flow, when the bar is in contact with the first potentiometer the current will flow in a first direction, and when the bar is in contact with the second potentiometer the current will flow in a second direction, whereby the toy will be powered in a first direction and a second direction.

9. The control cable recited in claim 8 wherein the control box has a steering wheel and a friction connection comprising said steering means and connecting said steering wheel to said spring wire with means for allowing said connection to stop relative to said wire which prevents damage to the wire when the control is oversteered.

* * * * *